US008646420B2

(12) United States Patent
Lee et al.

(10) Patent No.: US 8,646,420 B2
(45) Date of Patent: Feb. 11, 2014

(54) VARIABLE COMPRESSION RATIO APPARATUS

(75) Inventors: Eun Ho Lee, Hwaseong (KR); Jin Kook Kong, Suwon (KR); Soo Hyung Woo, Yongin (KR)

(73) Assignee: Hyundai Motor Company, Seoul (KR)

( * ) Notice: Subject to any disclaimer, the term of this patent is extended or adjusted under 35 U.S.C. 154(b) by 1126 days.

(21) Appl. No.: 12/617,493

(22) Filed: Nov. 12, 2009

(65) Prior Publication Data

US 2010/0326404 A1 Dec. 30, 2010

(30) Foreign Application Priority Data

Jun. 30, 2009 (KR) ..... 10-2009-0059076

(51) Int. Cl.
*F02B 75/04* (2006.01)

(52) U.S. Cl.
USPC ..... 123/48 B; 123/78 F

(58) Field of Classification Search
USPC ..... 123/48 R, 48 B, 78 R, 78 F
See application file for complete search history.

(56) References Cited

U.S. PATENT DOCUMENTS 6,247,430 B1 * 6/2001 Yapici ..... 123/78 F
6,588,384 B2 * 7/2003 Yapici ..... 123/78 F
6,971,342 B1 * 12/2005 Grabbe ..... 123/48 B
7,370,613 B2 * 5/2008 Lawrence et al. ..... 123/48 B
2004/0168657 A1 * 9/2004 Gooijer ..... 123/78 F
2004/0216704 A1 * 11/2004 Kassner ..... 123/48 B
2005/0183680 A1 * 8/2005 Goransson et al. ..... 123/78 F

FOREIGN PATENT DOCUMENTS

DE 3601528 A1 * 7/1987
EP 1245803 A1 * 10/2002
JP 55-64131 A 5/1980
WO WO0123722 A1 * 5/2001

* cited by examiner

*Primary Examiner* — Hung Q Nguyen
(74) *Attorney, Agent, or Firm* — Morgan, Lewis & Bockius LLP

(57) ABSTRACT

A variable compression ratio apparatus may include a cylinder block and a mounting hole formed at a side surface thereof; a connecting rod pivotally connected to the piston; a crankshaft provided with a central axis, a bearing seat coaxially disposed with the central axis, and a crank pin formed in a crank arm connecting the bearing seat with the central axis of the crank pin eccentrically, wherein the crank pin is rotatably connected to the connecting rod; and an eccentric bearing provided with a bearing central axis and a crank mounting hole formed eccentrically to the bearing central axis, the crank mounting hole of the eccentric bearing being rotatably coupled to the bearing seat rotatably inserted in the crank mounting hole, wherein the eccentric bearing changes the compression ratio by controlling a distance between the central axis and a combustion chamber according to driving condition of the vehicle.

8 Claims, 5 Drawing Sheets

VARIABLE COMPRESSION RATIO APPARATUS

CROSS-REFERENCE TO RELATED APPLICATION

The present application claims priority to Korean Patent Application No. 10-2009-0059076 filed on Jun. 30, 2009, the entire contents of which are incorporated herein for all purposes by this reference.

BACKGROUND OF THE INVENTION

1. Field of the Invention

The present invention relates to a variable compression ratio apparatus. More particularly, the present invention relates to a variable compression ratio apparatus that changes compression ratio of air-fuel mixture in a combustion chamber according to a driving condition of a vehicle.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

A conventional variable compression ratio apparatus includes a connecting rod connected to a piston and receiving combustion force of the air-fuel mixture, a pin link receiving the combustion force of the air-fuel mixture from the connecting rod and rotating a crankshaft, and control means changing a rotation trace of the pin link according to the driving condition of the engine. According to the conventional variable compression ratio apparatus, the compression ratio of the air-fuel mixture changes as the rotation trace of the pin link changes.

According to a conventional variable compression ratio apparatus, the control means are disposed vertically under the crankshaft or are disposed horizontally next to the crankshaft. Therefore, volume of the crank case may increase.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus having advantages of being installed in a cylinder block without increase in size of the cylinder block.

In an aspect of the present invention, the variable compression ratio apparatus that is mounted at an engine receiving combustion force of air-fuel mixture from a piston and driving a vehicle, and that changes compression ratio of the air-fuel mixture, may include a cylinder block having a cylinder formed at an upper portion thereof and a mounting hole formed at a side surface thereof, a connecting rod, one end of which is pivotally connected to the piston to receive the combustion force from the piston, a crankshaft provided with a central axis, a bearing seat coaxially disposed with the central axis, and a crank pin formed in a crank arm connecting the bearing seat with the central axis of the crank pin eccentrically, wherein the crank pin is rotatably connected to the other end of the connecting rod so as to receive the combustion force, and an eccentric bearing provided with a bearing central axis and a crank mounting hole formed eccentrically to the bearing central axis, the eccentric bearing being rotatably mounted in the mounting hole of the cylinder block and the crank mounting hole of the eccentric bearing being rotatably coupled to the bearing seat which is rotatably inserted in the crank mounting hole, wherein the eccentric bearing changes the compression ratio of the air-fuel mixture by controlling a distance between the central axis of the crankshaft and a combustion chamber of the engine according to driving condition of the vehicle.

The variable compression ratio apparatus may further include a control rod rotatably connected to a circumferential portion of the eccentric bearing which deviates from the bearing central axis with a predetermined distance so as to control an angular displacement of the eccentric bearing according to the driving condition of the vehicle, wherein one end of the control rod is rotatably connected to the circumferential portion of the eccentric bearing which deviates from the central axis, and the other end of the control rod is eccentrically and rotatably connected to a control cam rotating according to the driving condition of the vehicle, and wherein a connecting point of the eccentric bearing and the control rod is disposed opposite to the central axis of the crankshaft with reference to the bearing central axis so as to minimize a size of the eccentric bearing.

The central axis of the crankshaft may be disposed apart from the bearing central axis by between approximately 5 mm and approximately 7 mm.

The control cam may be coaxially connected to a control motor and rotates according to the driving condition of the vehicle.

In another aspect of the present invention, the variable compression ratio apparatus may include a cylinder block provided with a mounting hole, a crankshaft inserted in the mounting hole of the cylinder block and rotating in the cylinder block about a central axis thereof, and a connecting rod receiving combustion force of air-fuel mixture from a piston and eccentrically connected to the central axis of the crankshaft so as to convert the combustion force of the air-fuel mixture into rotational movement, wherein the crankshaft is rotatably mounted in the mounting hole in a state of being inserted in an eccentric bearing having a bearing central axis eccentric to the central axis, and wherein the eccentric bearing rotates according to driving condition of a vehicle so as to change compression ratio of the air-fuel mixture by controlling a distance between the central axis of the crankshaft and a combustion chamber of the engine.

The variable compression ratio apparatus may further include a control rod rotatably connected to a circumferential portion of the eccentric bearing which deviates from the bearing central axis so as to rotate the eccentric bearing according to the driving condition of the vehicle, wherein the control rod is eccentrically and rotatably connected to a control cam that rotates according to the driving condition of the vehicle at a portion except a connecting point of the eccentric bearing and the control rod, and wherein the connecting point of the eccentric bearing and the control rod is disposed opposite to the central axis of the crankshaft with reference to the bearing central axis so as to minimize a size of the eccentric bearing.

The central axis of the crankshaft may be disposed apart from the bearing central axis by between approximately 5 mm and approximately 7 mm.

The control cam may be coaxially connected to a control motor and rotates according to the driving condition of the vehicle.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
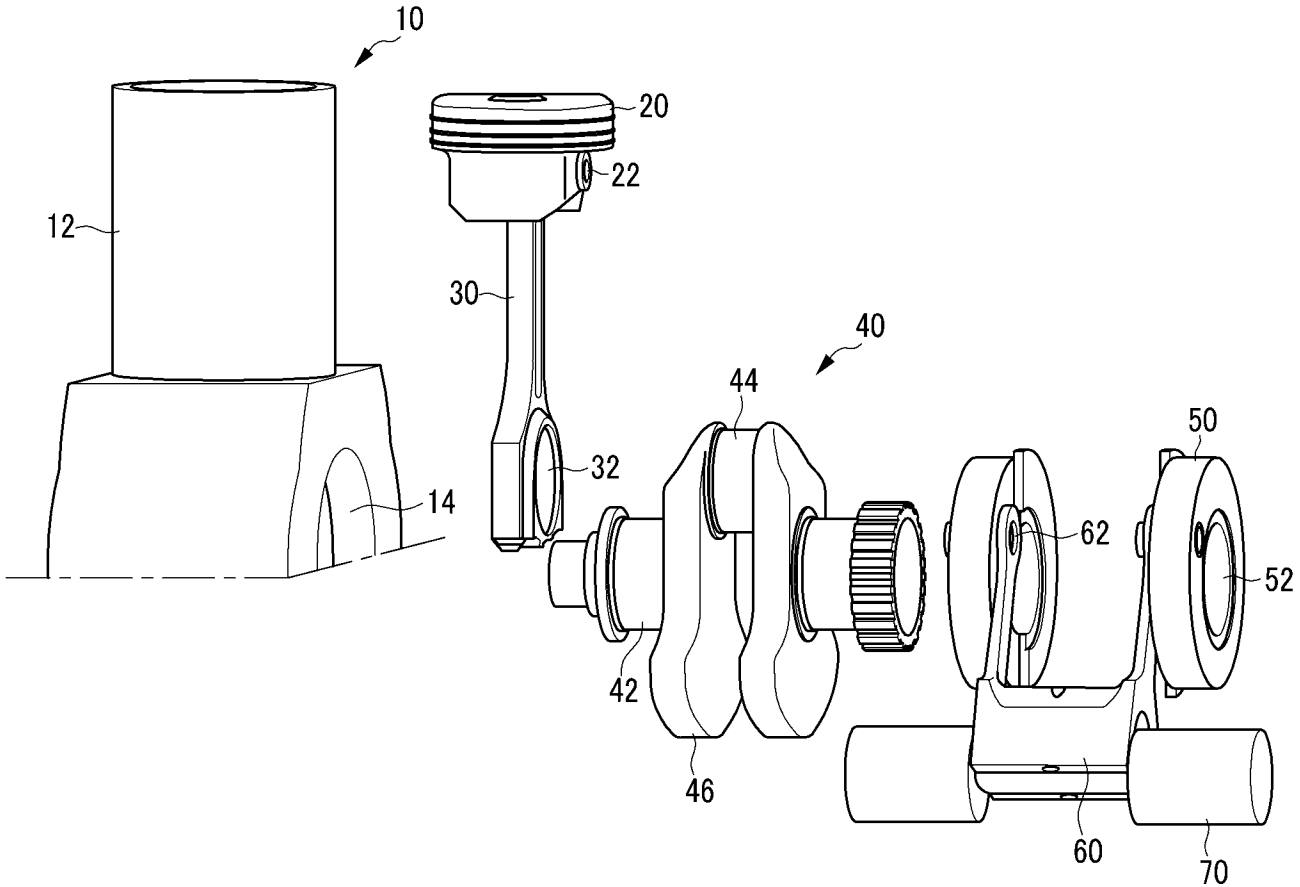
FIG. 1 is an exploded assembly view of a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
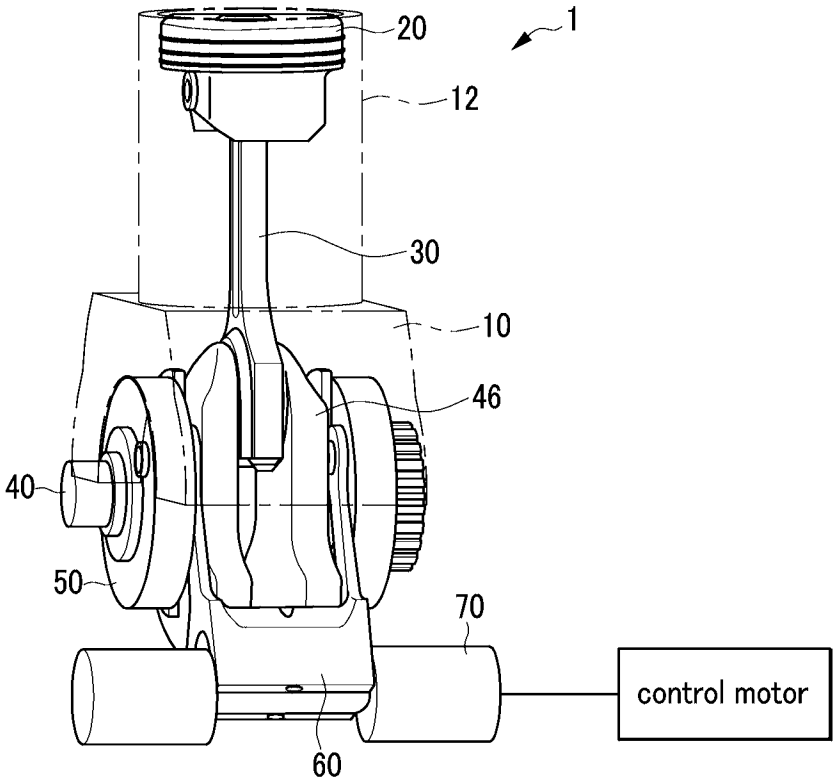
FIG. 2 is a perspective view of a variable compression ratio apparatus according to an exemplary embodiment of the present invention.

FIG. 1 is an exploded assembly view of a variable compression ratio apparatus according to an exemplary embodiment of the present invention; and FIG. 2 is a perspective view of a variable compression ratio apparatus according to an exemplary embodiment of the present invention.

As shown in FIG. 1 and FIG. 2, a variable compression ratio apparatus 1 according to an exemplary embodiment of the present invention is mounted at an engine which receives combustion force of air-fuel mixture from a piston 20 and rotates a crankshaft 40, and changes compression ratio of the air-fuel mixture according to driving condition of a vehicle. Such a variable compression ratio apparatus 1 is mounted in a cylinder block 10. For better comprehension and ease of description, a lower portion of the cylinder block 10 is omitted in FIG. 1 and FIG. 2.

The cylinder block 10 includes a cylinder 12 formed at an upper portion thereof and a mounting hole 14 formed at a side surface thereof for mounting the crankshaft 40. The crankshaft 40 is inserted in the mounting hole 14 and rotates therein.

The piston 20 is fittedly inserted in the cylinder 12, and a combustion chamber is formed between an upper surface of the piston 20 and the cylinder 12. The air-fuel mixture is flowed in the combustion chamber at an intake stroke and burns at an explosion stroke. The piston 20 reciprocates upwardly or downwardly by combustion force of the air-fuel mixture.

A connecting rod 30 includes both ends. One end of the connecting rod 30 is rotatably connected to a lower end of the piston 20 by coupling means such as a pin 22, and the other end of the connecting rod 30 is formed of a crank pin insert hole 32. Therefore, the connecting rod 30 receives the combustion force of the air-fuel mixture from the piston 20, and thereby reciprocates. Such reciprocal motion is converted into a rotational motion of the crankshaft 40, and thereby the crankshaft 40 rotates.

Figure 3:
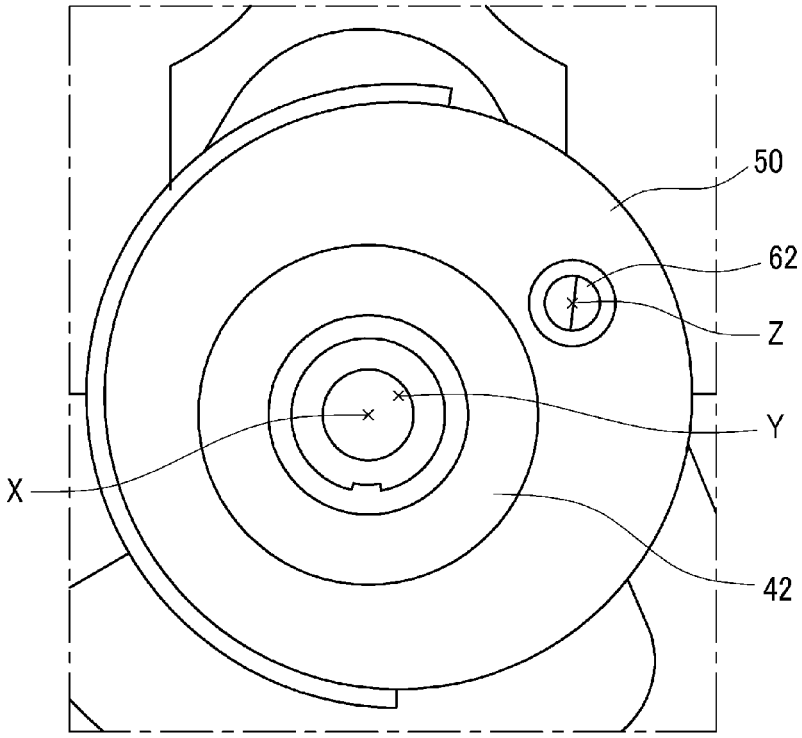
FIG. 3 is a side view showing an assembly of a crankshaft and an eccentric bearing in a variable compression ratio apparatus according to an exemplary embodiment of the present invention.

The crankshaft 40 is inserted in the mounting hole 14, and receives the combustion force of the air-fuel mixture from the connecting rod 30 so as to rotate about a central axis x (referring to FIG. 3). The crankshaft 40 includes a bearing seat 42 disposed coaxially with the central axis x and located in the mounting hole 14, a crank pin 44 formed eccentrically to the central axis x, and a crank arm 46 connecting the bearing seat 42 with the crank pin 44. The bearing seat 42, the crank pin 44, and the crank arm 46 may be integrally formed with each other, and may be separately formed and assembled. The crank pin 44 is inserted in the crank pin insert hole 32 of the connecting rod 30. Therefore, the other end of the connecting rod 30 is rotatably connected to the crank pin 44. Accordingly, the combustion force of the air-fuel mixture is transmitted to the crankshaft 40 through the connecting rod 30 and rotates the crankshaft 40.

An eccentric bearing 50 includes a bearing central axis y (referring to FIG. 3) and a crank mounting hole 52. The eccentric bearing 50 is inserted in the mounting hole 14 of the cylinder block 10 and reduces rotational friction of the crankshaft 40. Therefore, diameter of an exterior circumference of the eccentric bearing 50 is almost the same as that of an interior circumference of the mounting hole 14. The crank mounting hole 52 is formed eccentrically to the bearing central axis y, and the bearing seat 42 of the crankshaft 40 is rotatably inserted in the crank mounting hole 52. Therefore, a central axis of the crank mounting hole 52 is the same as the central axis x of the crankshaft 40, and the bearing central axis y is disposed apart from the central axis x of the crankshaft 40. A distance between the central axis x and the bearing central axis y may be 5-7 mm, and may be changed according to a size of the engine and a target compression ratio.

In addition, since the central axis x is eccentric to the bearing central axis y, a position of the central axis x is changed in a case that the eccentric bearing 50 rotates. That is, if the eccentric bearing 50 rotates to one direction (clockwise or counterclockwise), the central axis x moves to one direction (upward or downward). On the contrary, if the eccentric bearing 50 rotates to the other direction (counterclockwise or clockwise), the central axis x moves to the other direction (downward or upward). Therefore, the position of the central axis x of the crankshaft 40 changes according to rotation of the eccentric bearing 50, and accordingly the compression ratio of the air-fuel mixture changes.

The variable compression ratio apparatus 1 further includes a control rod 60 and a control cam 70 for rotating the eccentric bearing 50 according to driving condition of a vehicle.

The control rod 60 includes one end and the other end. The one end of the control rod 60 is rotatably connected to a circumferential portion of the eccentric bearing 50 which deviates from the bearing central axis y by coupling means such as a pin 62, and the other end of the control rod 60 is eccentrically and rotatably connected to the control cam 70.

The control cam 70 is coaxially connected to a control motor. The control motor is operated by a control signal of a control portion. Therefore, the control portion determines the driving condition of the vehicle based on detected values by detectors, and controls the control motor based on the driving condition of the vehicle. That is, the control portion determines whether the compression ratio of the air-fuel mixture should be changed, and outputs the control signal so as to drive the control motor if the compression ratio of the air-fuel mixture should be changed. Accordingly, the control motor rotates the control cam 70 and the control rod 60 connected to the control cam 70 rotates the eccentric bearing 50.

Meanwhile, the control rod 60 may be directly connected to the control motor and may be indirectly connected to the control motor by using other link members instead of using the control cam 70. In addition, the control rod 60 may be pivoted by using a hydraulic pressure device instead of using the control motor.

In a case that the bearing seat 42 is eccentrically connected to the eccentric bearing 50 and the pin 62 is eccentrically connected to the eccentric bearing 50 so as to achieve the target compression ratio, a size of the eccentric bearing 50 may increase. Increase in the size of the eccentric bearing 50 causes increase in a size of the cylinder block 10. Therefore, in order to minimize the size of the eccentric bearing 50, the control rod 60 is connected to the eccentric bearing 50 such that a center z of the pin 62 is disposed opposite to the central axis x of the crankshaft 40 with reference to the bearing central axis y (referring to FIG. 3).

Hereinafter, an operation of a variable compression ratio apparatus according to an exemplary embodiment of the present invention will be described.

Figure 4:
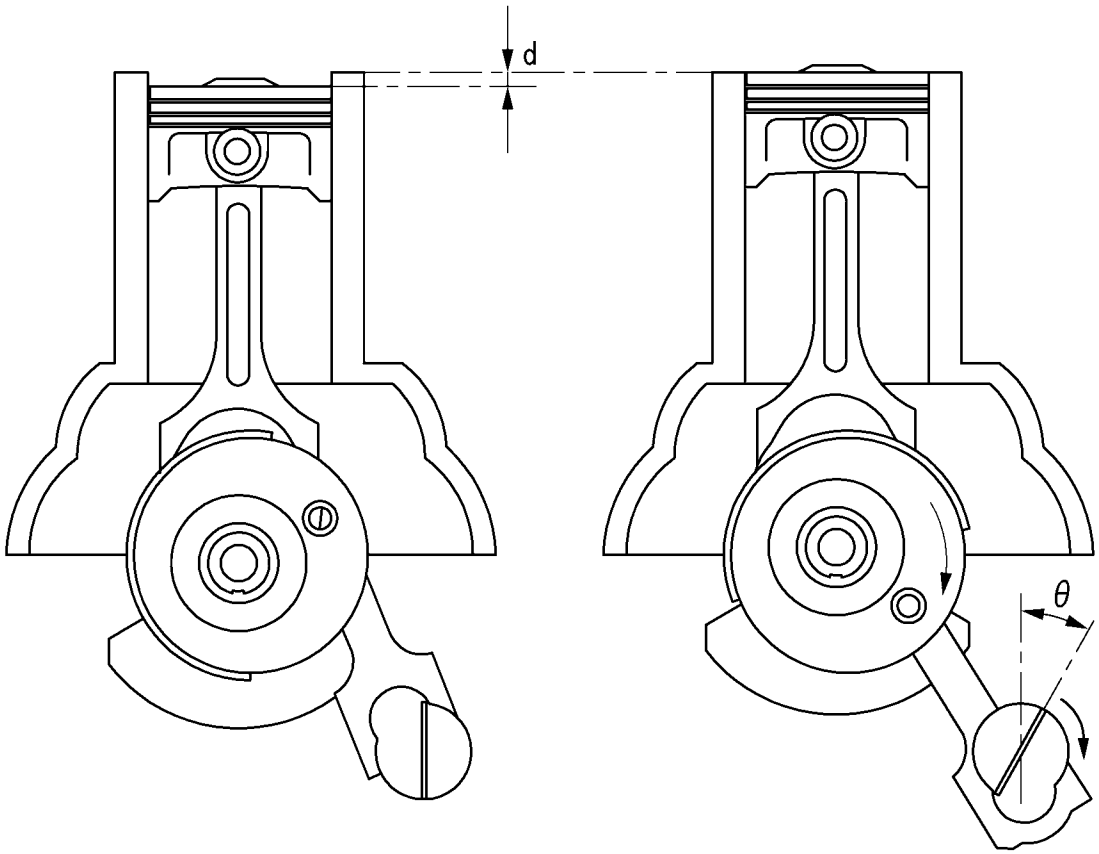
FIG. 4 is a schematic diagram showing change of compression ratio in a variable compression ratio apparatus according to an exemplary embodiment of the present invention.
Figure 5:
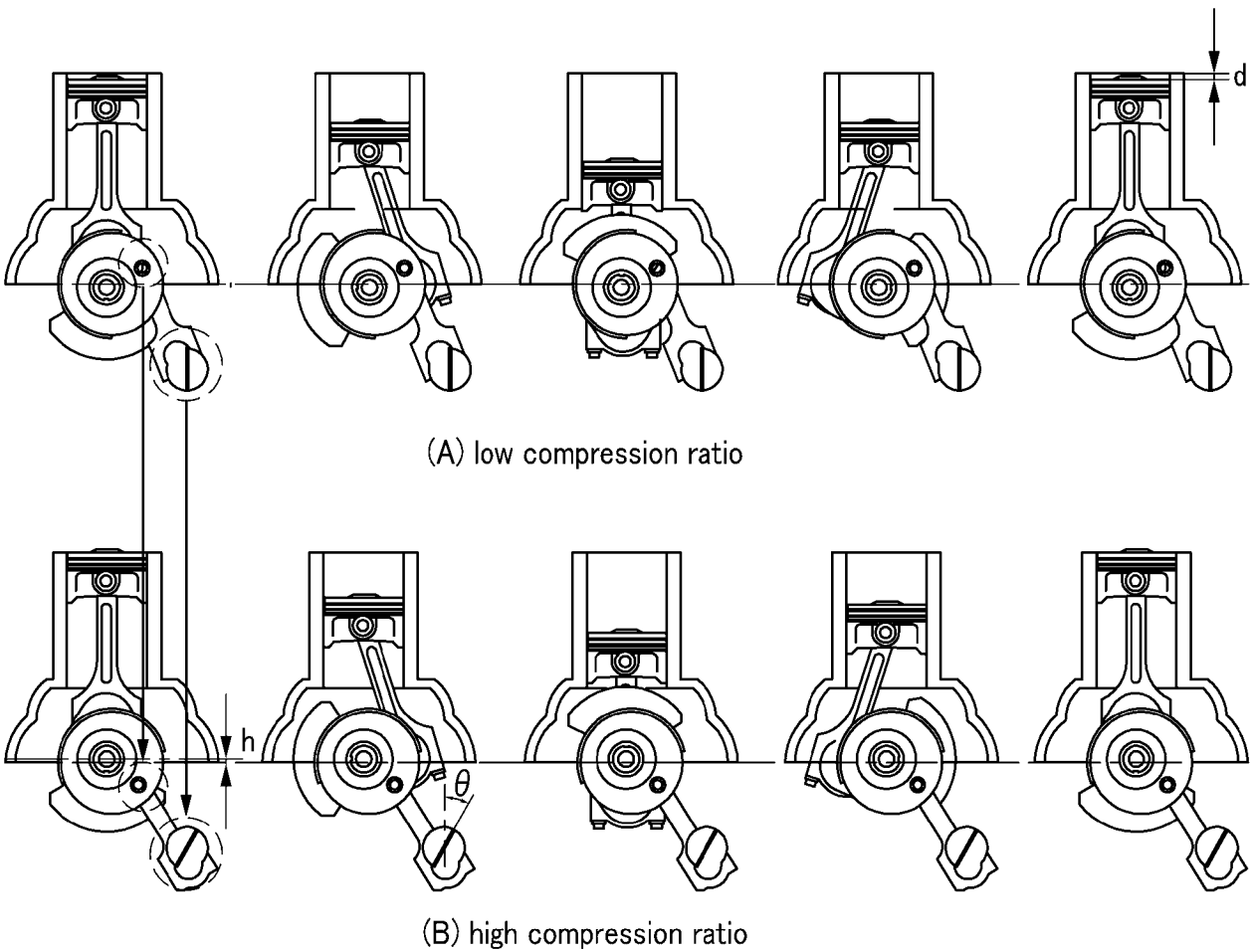
FIG. 5 is a schematic diagram showing operation of a variable compression ratio apparatus according to an exemplary embodiment of the present invention respectively at low compression ratio and high compression ratio.

FIG. 4 is a schematic diagram showing change of compression ratio in a variable compression ratio apparatus according to an exemplary embodiment of the present invention; and FIG. 5 is a schematic diagram showing operation of a variable compression ratio apparatus according to an exemplary embodiment of the present invention respectively at low compression ratio and high compression ratio.

A lower portion in FIG. 5 shows a variable compression ratio apparatus according to an exemplary embodiment of the present invention operating at a low compression ratio, and an upper portion in FIG. 5 shows a variable compression ratio apparatus according to an exemplary embodiment of the present invention operating at a high compression ratio.

It will be firstly described that the compression ratio of the air-fuel mixture is changed from the low compression ratio to the high compression ratio. The control portion determines the driving condition of the vehicle based on the detected values by the detectors, and determines that the compression ratio of the air-fuel mixture should be changed from the low compression ratio to the high compression ratio. At this time, the control portion drives the control motor so as to rotate the control cam 70 clockwise by a predetermined angle θ. In this case, the control rod 60 rotates the eccentric bearing 50 clockwise by a predetermined angle, and a mounting height of the crankshaft 40 eccentrically mounted in the eccentric bearing 50 is raised by a predetermined height h. Therefore, the compression ratio of the air-fuel mixture is changed to the high compression ratio. That is, as shown in FIG. 5, the piston 20 is raised by a predetermined height d in a case of the high compression ratio compared with the low compression ratio, and the compression ratio is raised.

On the contrary, in a case that the compression ratio of the air-fuel mixture is changed from the high compression ratio to the low compression ratio, the control cam 70 is rotated counterclockwise by the predetermined angle θ and the mounting height of the crankshaft 40 is lowered by the predetermined height h. Therefore, the compression ratio of the air-fuel mixture is changed to the low compression ratio.

As described above, the compression ratio of the air-fuel mixture is changed according to rotating angle θ of the control cam 70, and the rotating angle θ of the control cam 70 can be set according to a target engine performance by a person of an ordinary skill in the art.

According to an exemplary embodiment of the present invention, a connecting point of an eccentric bearing and a control rod is disposed opposite to a central axis of a crankshaft with reference to a bearing central axis. Therefore, compression ratio of air-fuel mixture may be sufficiently changed without increase in a size of the eccentric bearing.

In addition, since the compression ratio of the air-fuel mixture is changed according to driving condition of a vehicle, fuel mileage may be improved.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus that is mounted at an engine receiving combustion force of air-fuel mixture from a piston and driving a vehicle, and that changes compression ratio of the air-fuel mixture, the variable compression ratio apparatus comprising:

a cylinder block having a cylinder formed at an upper portion thereof and a mounting hole formed at a side surface thereof;

a connecting rod, one end of which is pivotally connected to the piston to receive the combustion force from the piston;

a crankshaft provided with a central axis, a bearing seat coaxially disposed with the central axis, and a crank pin formed in a crank arm connecting the bearing seat with the central axis of the crank pin eccentrically, wherein the crank pin is rotatably connected to the other end of the connecting rod so as to receive the combustion force;

an eccentric bearing provided with a bearing central axis and a crank mounting hole formed eccentrically to the bearing central axis, the eccentric bearing being rotatably mounted in the mounting hole of the cylinder block and the crank mounting hole of the eccentric bearing being rotatably coupled to the bearing seat which is rotatably inserted in the crank mounting hole, wherein the eccentric bearing changes the compression ratio of the air-fuel mixture by controlling a distance between the central axis of the crankshaft and a combustion chamber of the engine according to driving condition of the vehicle; and a control rod rotatably connected to a circumferential portion of the eccentric bearing which deviates from the bearing central axis with a predetermined distance so as to control an angular displacement of the eccentric bearing according to the driving condition of the vehicle;

wherein one end of the control rod is rotatably connected to the circumferential portion of the eccentric bearing which deviates from the bearing central axis, and the other end of the control rod is eccentrically and rotatably connected to a control cam rotating according to the driving condition of the vehicle.

2. The variable compression ratio apparatus of claim 1, wherein a connecting point of the eccentric bearing and the control rod is disposed opposite to the central axis of the crankshaft with reference to the bearing central axis so as to minimize a size of the eccentric bearing.

3. The variable compression ratio apparatus of claim 1, wherein the central axis of the crankshaft is disposed apart from the bearing central axis by between approximately 5 mm and approximately 7 mm.

4. The variable compression ratio apparatus of claim 1, wherein the control cam is coaxially connected to a control motor and rotates according to the driving condition of the vehicle.

5. A variable compression ratio apparatus comprising:

a cylinder block provided with a mounting hole;

a crankshaft inserted in the mounting hole of the cylinder block and rotating in the cylinder block about a central axis thereof;

a connecting rod receiving combustion force of air-fuel mixture from a piston and eccentrically connected to the central axis of the crankshaft so as to convert the combustion force of the air-fuel mixture into rotational movement, wherein the crankshaft is rotatably mounted in the mounting hole in a state of being inserted in an eccentric bearing having a bearing central axis eccentric to the central axis, and wherein the eccentric bearing rotates according to driving condition of a vehicle so as to change compression ratio of the air-fuel mixture by controlling a distance between the central axis of the crankshaft and a combustion chamber of the engine, and a control rod rotatably connected to a circumferential portion of the eccentric bearing which deviates from the bearing central axis so as to rotate the eccentric bearing according to the driving condition of the vehicle;

wherein the control rod is eccentrically and rotatably connected to a control cam that rotates according to the driving condition of the vehicle at a portion except a connecting point of the eccentric bearing and the control rod.

6. The variable compression ratio apparatus of claim 5, wherein the connecting point of the eccentric bearing and the control rod is disposed opposite to the central axis of the crankshaft with reference to the bearing central axis so as to minimize a size of the eccentric bearing.

7. The variable compression ratio apparatus of claim 5, wherein the central axis of the crankshaft is disposed apart from the bearing central axis by between approximately 5 mm and approximately 7 mm.

8. The variable compression ratio apparatus of claim 5, wherein the control cam is coaxially connected to a control motor and rotates according to the driving condition of the vehicle.

* * * * *